US005095854A

United States Patent [19]

Dietz

[11] Patent Number: 5,095,854

[45] Date of Patent: Mar. 17, 1992

[54] FLUIDIZED BED REACTOR AND METHOD FOR OPERATING SAME UTILIZING AN IMPROVED PARTICLE REMOVAL SYSTEM

[75] Inventor: David H. Dietz, Hampton, N.J.

[73] Assignee: Foster Wheeler Development Corporation, Livingston, N.J.

[21] Appl. No.: 669,549

[22] Filed: Mar. 14, 1991

[51] Int. Cl.[5] ..... F22B 1/00

[52] U.S. Cl. ..... 122/4 D; 110/245

[58] Field of Search ..... 122/4 D; 110/245

[56] References Cited

U.S. PATENT DOCUMENTS

| | | | |
|---|---|---|---|
| 3,893,426 | 7/1975 | Bryers . | |
| 3,902,462 | 9/1975 | Bryers . | |
| 4,111,158 | 9/1978 | Reh et al. . | |
| 4,165,717 | 8/1979 | Reh et al. . | |
| 4,227,488 | 10/1980 | Stewart et al. . | |
| 4,469,050 | 9/1984 | Korenberg . | |
| 4,548,138 | 10/1985 | Korenberg | 110/245 |
| 4,594,967 | 6/1986 | Wolowodiuk . | |
| 4,686,939 | 8/1987 | Stromberg . | |
| 4,694,758 | 9/1987 | Gorzegno et al. . | |
| 4,709,662 | 12/1987 | Rawdon . | |
| 4,716,856 | 1/1988 | Beisswenger et al. . | |
| 4,809,623 | 3/1989 | Garcia-Mallol . | |
| 4,809,625 | 3/1989 | Garcia-Mallol et al. . | |
| 4,813,479 | 3/1989 | Wahlgren | 122/4 D |
| 4,829,912 | 5/1989 | Alliston et al. . | |
| 4,856,460 | 8/1989 | Wied et al. . | |
| 4,896,717 | 1/1990 | Campbell, Jr. et al. . | |
| 4,947,804 | 8/1990 | Abdulalby | 122/4 D |
| 4,969,930 | 11/1990 | Arpalahti . | |
| 5,005,528 | 4/1991 | Virr | 122/4 D |

*Primary Examiner*—Henry C. Yuen

*Attorney, Agent, or Firm*—Marvin A. Naigur

[57] ABSTRACT

A fluidized bed reactor in which a bed of particulate material including fuel is formed in a furnace section. Air is passed through the bed at a velocity to fluidize said material and promote the combustion of the fuel. A cooler is located adjacent the vessel for receiving particulate material from the vessel and for removing heat from the material. Drain pipes are provided in the furnace section and in the cooler for selectively removing particulate material from the furnace section and the cooler.

9 Claims, 2 Drawing Sheets

FLUIDIZED BED REACTOR AND METHOD FOR OPERATING SAME UTILIZING AN IMPROVED PARTICLE REMOVAL SYSTEM

BACKGROUND OF THE INVENTION

This invention relates to a fluidized bed reactor and method for operating same and, more particularly, to a fluidized bed reactor utilizing an improved system for removing particulate material from the reactor bed.

Reactors, such as combustors, steam generators and the like, utilizing fluidized beds as the primary source of heat generation are well known. In these arrangements, air is passed through a bed of particulate material, including a fossil fuel, such as coal, and an adsorbent for the sulfur generated as a result of combustion of the coal, to fluidize the bed and to promote the combustion of the fuel at relatively low temperatures. When the reactor is utilized as a steam generator, the heat produced by the fluidized bed is utilized to convert water to steam which results in an attractive combination of high heat release, high sulfur adsorption, low nitrogen oxides emissions and fuel flexibility.

The most typical fluidized bed combustion system is commonly referred to as a "bubbling" fluidized bed in which a bed of particulate material is supported by an air distribution plate, to which combustion-supporting air is introduced through a plurality of perforations in the plate, causing the material to expand and take on a suspended, or fluidized, state. The gas velocity is typically two to three times that needed to develop a pressure drop which will support the bed weight (e.g., minimum fluidization velocity), causing the formation of bubbles that rise up through the bed and give the appearance of a boiling liquid.

In an effort to extend the improvements in combustion efficiency, pollutant emissions control, and operation turn-down afforded by the bubbling bed, a fluidized bed reactor has been developed utilizing a "circulating" fluidized bed. In these arrangements the mean gas velocity is increased above that for the bubbling bed, so that the bed surface becomes more diffused and the solids entrainment from the bed is increased. According to this process, fluidized bed densities are attained which are well below those typical of the bubbling fluidized bed. The formation of the low density circulating fluidized bed is due to its small particle size and to a high solids throughput, which require high solids recycle. The velocity range of a circulating fluidized bed is between the solids terminal, or free fall, velocity and a velocity beyond which the bed would be converted into a pneumatic transport line.

U.S. Pat. Nos. 4,809,623 and 4,809,625, assigned to the same assignee as the present application, disclose a fluidized bed reactor in which a dense, or bubbling, bed is maintained in the lower portion of the furnace, while the bed otherwise is operated as a circulating bed. The design is such that advantages of both a bubbling bed and a circulating bed are obtained, not the least significant advantage being the ability to utilize particulate fuel material extending over a greater range of particle sizes.

In these designs a homogenous mixture of fuel particles and adsorbent particles (hereinafter collectively referred to as "particulate material") is formed, with a portion of the fuel particles being unburned, a portion being partially burned and a portion being completely burned and a portion of the adsorbent being unreacted, a portion being partially reacted and a portion being completely reacted. The particulate material must be discharged from the system quickly and efficiently to accommodate the continuous introduction of fresh fuel and adsorbent. To this end, a portion of the particulate material is usually passed from the lower portion of the bed to one or more stripper/coolers located adjacent the furnace section of the reactor. Air is blown through the stripper section of the stripper/cooler to entrain some of the relatively fine particulate material which is returned to the furnace. The remaining particulate material in the stripper/cooler is passed to its cooler section and water/steam is passed in a heat exchange relation to the latter material to remove heat from the material before it is discharged from the system.

However, in some situations, such as when fuels that generate a lot of relatively fine ash are used, or when a relatively large amount of relatively fine adsorbent has to be used with fuels having a relatively high sulfur content, the relatively fine particle material stripped in the stripper/cooler and returned to the furnace section increases the volume of the fines, or the "loading" in the upper furnace section of the reactor, to unacceptable levels. This requires large and expensive stripper/coolers and/or requires that the furnace be operated at low stoichiometry, which is inefficient. Also, these stripper/coolers cannot handle very large amounts of relative coarse material. Thus, these prior art stripper/coolers limit the range of particle sizes that can be used to maintain adequate efficiency.

SUMMARY OF THE INVENTION

It is therefore an object of the present invention to provide a fluidized bed reactor in which relative fine particulate material is removed from the furnace section of the reactor and passed to a separate cooler.

It is a further object of the present invention to provide a fluidized bed reactor of the above type in which the level of the particulate material in the furnace section of the reactor is controlled by the level of the material in the cooler.

It is a further object of the present invention to provide a fluidized bed reactor of the above type in which the particulate material in the cooler is removed from the cooler.

It is a further object of the present invention to provide a fluidized bed reactor of the above type in which relatively/coarse particulate material is removed directly from the furnace section and cooled.

It is a further object of the present invention to provide a fluidized bed reactor of the above type in which loading in the upper furnace section of the reactor is not increased.

It is a still further object of the present invention to provide a fluidized bed reactor of the above type which can accommodate relatively large amounts of coarse particulate material.

Towards the fulfillment of these and other objects, the reactor of the present invention features the provision of one or more coolers located adjacent the furnace section for receiving particulate material from the fluidized bed in the furnace section. The particulate material is circulated through the cooler and is used to control the level of fluidized bed in the furnace section. Relatively coarse particulate material is removed directly from the fluidized bed in the furnace section and passed to a separate cooler.

BRIEF DESCRIPTION OF THE DRAWINGS

The above brief description as well as further objects, features and advantages of the method of the present invention will be more fully appreciated by reference to the following detailed description of presently preferred but nonetheless illustrative embodiments in accordance with the present invention when taken in conjunction with the accompanying drawing in which.

DESCRIPTION OF THE PREFERRED EMBODIMENT

Figure 1:
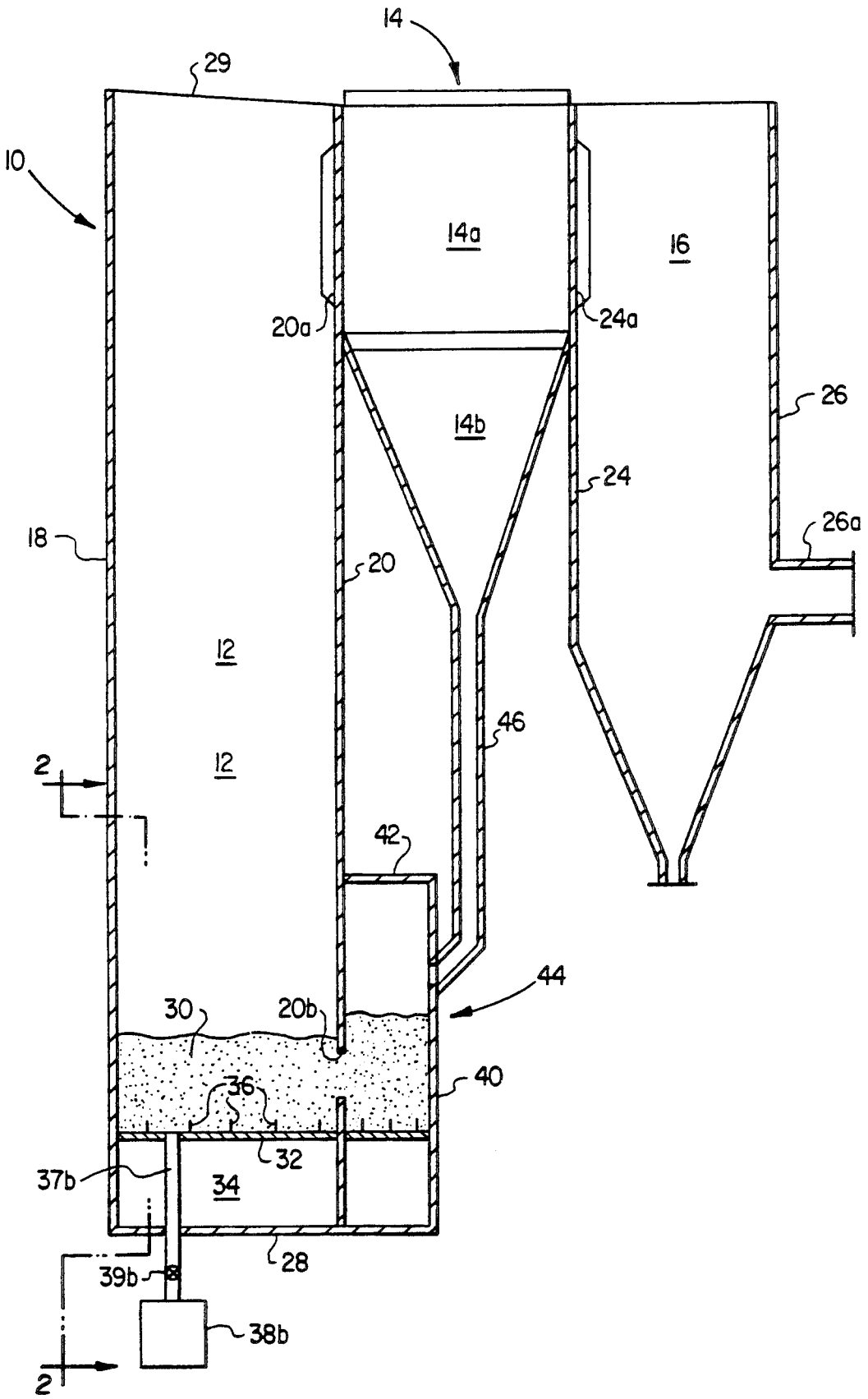
FIG. 1 is a sectional view of a steam generating system employing the fluidized bed reactor of the present invention.

FIG. 1 depicts a steam generating system including the fluidized bed reactor of the present invention which is shown in general by the reference numeral 10. The reactor 10 includes a furnace section 12, a separating section 14 and a heat recovery section 16 all shown in a sectional view with their internal components removed, for the convenience of presentation.

Figure 2:
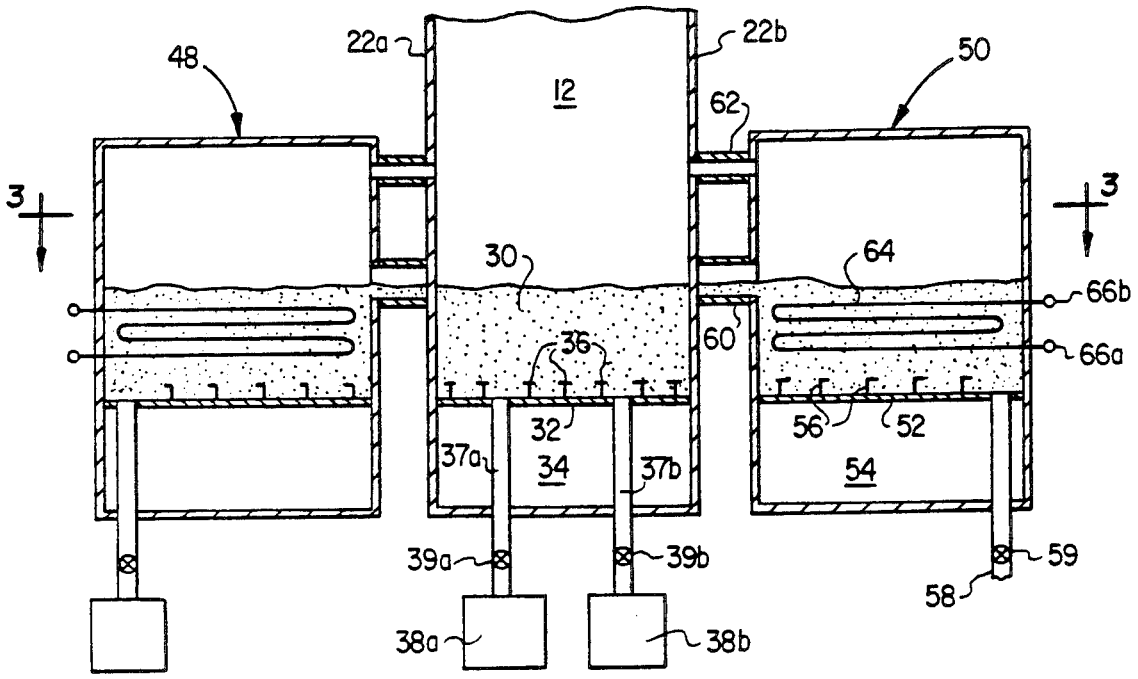
FIG. 2 is a cross-sectional view taken along the line 2—2 of FIG. 1.

Referring to FIGS. 1 and 2, the furnace section 12 is defined by a front wall 18, a rear wall 20 and two sidewalls 22*a* and 22*b*. Two walls 24 and 26 are provided in a spaced parallel relation to the wall 20 with the separating section 14 being defined by the walls 20 and 24, and the heat recovery section 16 being defined by the walls 24 and 26. A floor 28 is provided in the furnace section 12 and a roof 29 extends over the furnace section 12, the separating section 14 and the heat recovery section 16. Although not shown in the drawings, it is understood that the separating section 14 and the heat recovery section 16 are provided with sidewalls, which can be extensions of the sidewalls 22*a* and 22*b*.

Openings 20*a* and 24*a* are provided in the upper portions of the walls 20 and 24, respectively, for permitting gases to pass from the furnace section 12 into the separating section 14 and, from the separating section to the heat recovery section 16, as will be explained.

It is understood that if the reactor 10 is used for the purpose of steam generation, the walls 18, 20, 22*a*, 22*b*, 24 and 26 would be formed by a plurality of heat exchange tubes formed in a parallel, airtight manner to carry the fluid to be heated, such as water. It is also understood that a plurality of headers (not shown) would be disposed at both ends of the walls 18, 20, 22*a*, 22*b*, 24 and 26 which, along with additional tubes and associated water flow circuitry, would function to route the water through the interior of the reactor and to and from a steam drum (not shown) in a conventional manner. These components are omitted in the drawings for the convenience of presentation.

A bed of particulate material, shown in general by the reference numeral 30, is disposed within the furnace section 12 and rests on a perforated plate 32 extending horizontally in the lower portion of the furnace section. The bed 30 can consist of discrete particles of fuel material, such as bituminous coal, which are introduced into the furnace section 12 by a feeder or the like in any known manner. It is understood that a sulfur adsorbent material, such as limestone, can also be introduced into the furnace section 12 in a similar manner which material adsorbs the sulfur generated by the burning coal, also in a conventional manner.

It is also understood that a bed light-off burner (not shown) is mounted through the front wall 18 immediately above the plate 32 for initially lighting off a portion of the bed 30 during start-up.

A plenum 34 is defined between the plate 32 and the floor 28 and receives pressurized air from an external source. A plurality of nozzles 36 extend through perforations provided in the plate 32 and are adapted to discharge air from the plenum 34 into the bed of particulate material supported on the plate. The air passing through the bed 30 fluidizes the bed and combines with the products of combustion from the burning coal in the bed 30. The resulting mixture entrains a portion of the relatively fine particulate coal material in the furnace section 12 before passing, via the opening 20*a*, into the separating section 14.

A pair of drain pipes 37*a* and 37*b* extend from enlarged openings in the plate 32, through the plenum 34 and are connected to two coolers 38*a* and 38*b*, respectively located below the plenum. The coolers 38*a* and 38*b* can be of any conventional design such as screw coolers, ash coolers, or the like. Two control valves 39*a* and 39*b* are provided in the pipes 37*a* and 37*b* to control the flow of particles to the coolers 38*a* and 38*b*, respectively.

The separating section 14 includes a cyclone separator 14*a* which functions in a conventional manner to separate the entrained solid particles from the mixture of air and combustion gases. The separated gases pass through the opening 24*a* in the wall 24 to the heat recovery section 16 and the separated solids pass into a hopper portion 14*b* of the separator section 14. It is understood that one or more heat exchange units, such as a superheater, reheater or the like can be provided in the heat recovery section 16 for removing the heat from the separated gases as they pass downwardly in the section 16 before exiting through an outlet 26*a* extending through the wall 26.

Figure 3:
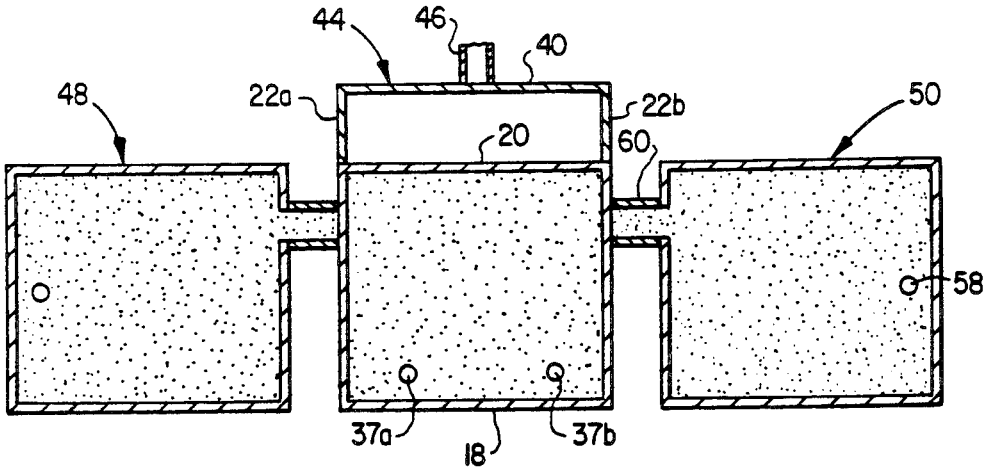
FIG. 3 is a cross-sectional view taken along the line 3—3 of FIG. 2.

Referring to FIGS. 1 and 3, the plate 32 and the floor 28 extend past the rear wall 20 and, together with a vertical wall 40 and a horizontal wall 42, define a heat exchange enclosure 44. A dip leg 46 extends from the hopper portion 14*b* of the separator section 14 to an opening in the wall 40 of the enclosure 44 to pass the separated solids from the hopper portion 14*b* to the enclosure 44. The separated solids in the enclosure 44 are fluidized by air from that portion of the plenum 34 extending below the enclosure 44. An opening 20*b* (FIG. 1) is provided in the lower portion of the wall 20 to permit the separated solids to pass from the enclosure 44 back into the furnace section 12.

Although not shown in the drawings, it is understood that heat exchange tubes, or the like, can be provided in the enclosure 44 to remove heat from the separated solids therein. The heat exchange enclosure 44 can also be provided with one or more bypass compartments (not shown) for passing the separated solids directly through the enclosure 44 without encountering any heat exchange surfaces. For further details of this and the structure and function of the heat exchange enclosure 44 reference is made to applicants' co-pending application Ser. No. 07/700,294, the disclosure of which is hereby incorporated by reference.

Referring to FIGS. 2 and 3, a pair of coolers 48 and 50 are disposed adjacent the sidewalls 22*a* and 22*b*, respectively. Since the cooler 48 is identical to the cooler 50, only the later cooler will be described in detail it being understood that the cooler 48 is identical and functions in the same manner, as the cooler 50.

A perforated plate 52 is disposed in the lower portion of cooler 50 and forms therewith a plenum 54. The plate 52 is perforated and receives a plurality of nozzles 56 which are directed to discharge air from the plenum 44 toward a drain pipe 58 extending through an enlarged opening in the plate 52. The drain pipe 58 extends through the floor of the cooler 50 and projects from the later housing. A valve 59 is provided in the drain pipe 58 to control the flow of particles through the pipe.

A relatively large horizontal pipe 60 connects an opening formed in the sidewall **22*b* of the enclosure 10 to a corresponding opening formed in the adjacent wall of the cooler 50 to permit the separated solids from the furnace section 12 to pass into the cooler 50. Similarly, a relatively small vent pipe 62 is located above the pipe 60 and connects corresponding openings in the wall 22*b* and the adjacent wall of the cooler 50**.

A bank of heat exchange tubes, shown in general by the reference numeral 64 in FIG. 2, are disposed in the cooler 50 immediately above the plate 52 and within the level of solids that accumulates on the plate. The tubes 64 extend between an inlet header **66*a* and outlet header 66*b* for circulating water through the tubes to remove heat from the separated solids in the cooler 50**.

To start up the system, particulate fuel material and adsorbent are introduced into the furnace section 12 and accumulate on the plate 32. Air from an external source passes into the plenum 34, through the plate 32, and the nozzles 36 and into the particulate material on the plate to form the fluidized bed 30.

A light-off burner (not shown) or the like, is disposed in the furnace section 12 and is fired to ignite the particulate fuel material in the bed 30. When the temperature of the material in the bed 30 reaches a higher level, additional particulate material is continuously discharged onto the upper portion of the material in the bed 30. The air promotes the combustion of the fuel particles and the velocity of the air is increased until it exceeds the minimum fluidizing velocity and the bed is fluidized.

As the fuel particulates burn and the adsorbent particles are reacted, the continual influx of air creates a homogenous fluidized bed of particulate material including unburned fuel, partially-burned fuel, and completely-burned fuel along with unreacted adsorbent, partially-reacted adsorbent and completely-reacted adsorbent.

A mixture of air and gaseous products of combustion pass upwardly through the bed 30 and entrain, or elutriate, the relatively fine particulate material in the bed. The resulting mixture passes upwardly in the furnace section 12 by convection before it exits the furnace section through the opening **20*a* and passes into the separating section 14. The separator 14*a* functions in a conventional manner to separate the gases from the entrained particulate material. The separated, relatively free, particulate material falls by gravity into the hopper 14*b* from which it is injected, via the dipleg 46, into the enclosure 44. The relatively clean gases pass through the opening 24*a*, into the heat recovery section 16 and through the latter section before exiting, via the outlet 26*a***.

Referring to FIGS. 2 and 3, the level of the bed 30 extends above the lower portion of the pipe 60. Thus, some of the particulate material from the bed 30 passes, via the pipe 60, into the cooler 50. This particulate material is relatively fine since the pipe 60 is located near the wall 20 and since the relatively fine particulate material from the enclosure 44 passes into the furnace section 12 through an opening in the wall 20. The relatively fine particulate material builds up in the cooler 50 and air is introduced into the plenum 54 and discharges, via the nozzles 56, into the upper portion of the cooler 50 in sufficient velocities to fluidize the particulate material in the cooler.

Heat is removed from the particulate material in the cooler 50 by circulating relatively cool fluid through the tubes 64, via the headers **66*a* and 66*b*. The relatively fine particulate material in the cooler 50 can be selectively discharged, via the drain pipe 58, to external equipment under control of the valve 59 and thus control the levels of the bed 30 in the cooler 50 and therefore the level of the bed in the furnace section 12**.

The drain pipes **37*a* and 37*b* function to discharge particulate material from the furnace section 12 to the coolers 38*a* and 38*b* under control of the valves 39*a* and 39*b*. Since the drain pipes 37*a* and 37*b* are located near the wall 18 they pass relatively coarse particles to the coolers 38*a* and 38*b*. In this manner the ratio of relatively fine particulate material to relatively coarse particulate material can be controlled by controlling the amount of particulate material discharged from the drain pipes 37*a* and 37*b***.

It is thus seen that the device of the present invention provides several advantages. For example, it permits controlled removal of the finer particulate material into the cooler 50 and the removal of the heat therefrom. Also, by use of the valve 59 in the drain pipe 58 the level of the bed in the cooler 50, and therefore the bed 30, can be precisely controlled. Further, the present invention permits separate controlled removal of the coarser particulate material directly from the bed 30 via the drain pipes **37*a* and 37*b***. Also the system of the present invention permits stoichiometry and furnace loading to be independently set.

It is understood that variations may be made in the foregoing without departing from the scope of the invention. For example, the horizontal pipe 60 can be replaced by a vertical pipe located within the enclosure 12 whose upper end is located at the desired location of the upper surface of the bed 30.

Other changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A reactor comprising a furnace section, means for forming a bed of particulate material including fuel in said furnace section, means for passing air through said bed at a velocity to fluidize said material, to segregate said particulate material such that relatively fine particulate material migrates toward the upper portion of said bed and relatively coarse particulate material migrates toward the lower portion of said bed, and to promote the combustion of said fuel, means for removing said relatively coarse particulate material from said lower portion of said bed, cooling means disposed adjacent said furnace section, means for passing said relatively fine particulate material from said upper portion of said bed to said cooling means, means for fluidizing said relatively fine particulate material in said cooling means, means for removing heat from said relatively fine particulate material in said cooling means and means for removing said relatively fine particulate material from said cooling means independently of the removal of said coarse particulate material from said lower portion of said bed to independently control the amount of particulate material in said furnace section and said cooling means, respectively, and to control the ratio of said relatively fine particulate material in said bed to said relatively coarse particulate material in said bed.

2. The reactor of claim 1 wherein said passing means comprises a horizontal duct entering through aligned openings in the respective walls of said furnace section and said cooling means.

3. The reactor of claim 1 wherein said heat removing means comprises a plurality of heat exchange tubes in said cooling means, and means for passing a cooling fluid through said tubes.

4. The reactor of claim 1 wherein said air and the gases from the combustion of said fuel mix and entrain a relatively fine portion of said particulate material, and further comprising means for separating said entrained fine particulate material from said air and gases and passing the separated fine particulate material back to said bed.

5. The reactor of claim 4 wherein said separated fine particulate material is reintroduced to a section of said bed and wherein said passing means is located adjacent said section for receiving said reintroduced relatively fine particulate material and passing it to said cooling means.

6. The reactor of claim 1 wherein said passing means is located at a height corresponding to the height of said fluidized bed in said furnace section.

7. A method for operating a fluidized bed reactor comprising the steps of forming a bed of particulate material including fuel in a furnace section, passing air through said bed at a velocity to fluidize said material, segregate said particulate material such that relatively fine particulate material migrates toward the upper portion of said bed and relatively coarse particulate material migrates toward the lower portion of said bed, and promote the combustion of said fuel, removing said relatively coarse particulate material from said lower portion of said bed, passing said relatively fine particulate material from said upper portion of said bed to a cooler, fluidizing said relatively fine particulate material in said cooler, removing heat from said relatively fine particulate material in said cooler, and removing said relatively fine particulate material from said cooler independently of the removal of said coarse particulate material from said lower portion of said bed to independently control the amount of particulate material in said furnace section and said cooler, respectively, and to control the ratio of said relatively fine particulate material in said bed to said relatively coarse particulate material in said bed.

8. The method of claim 7 wherein said air and the gases from the combustion of said fuel mix and entrain a portion of the relatively fine particulate material in said furnace section, and further comprising the step of separating said entrained fine particulate material from said air and gases and passing said separated fine particulate material back to said bed.

9. The method of claim 8 wherein said separated fine particulate material is passed back to a section of said bed and wherein that portion of said particulate material passed from said furnace section to said cooler is relatively fine particulate material passed from said section of said bed.

* * * * *